US011352910B2

(12) United States Patent
Leidinger et al.

(10) Patent No.: US 11,352,910 B2
(45) Date of Patent: Jun. 7, 2022

(54) STEAM TURBINE AND METHOD FOR OPERATING SAME

(71) Applicant: Siemens Energy Global GmbH & Co. KG, Munich (DE)

(72) Inventors: Bernd Leidinger, Dresden (DE); Stefan Preibisch, Görlitz (DE); Stefanie Ruhsland, Bischdorf (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 139 days.

(21) Appl. No.: 16/625,737

(22) PCT Filed: Feb. 14, 2018

(86) PCT No.: PCT/EP2018/053634
§ 371 (c)(1),
(2) Date: Dec. 22, 2019

(87) PCT Pub. No.: WO2019/007557
PCT Pub. Date: Jan. 10, 2019

(65) Prior Publication Data

US 2021/0156283 A1 May 27, 2021

(30) Foreign Application Priority Data

Jul. 3, 2017 (DE) ..... 10 2017 211 295.6

(51) Int. Cl.
*F01K 7/22* (2006.01)
*F01D 25/26* (2006.01)
*F01D 25/12* (2006.01)

(52) U.S. Cl.
CPC ..... *F01K 7/22* (2013.01); *F01D 25/26* (2013.01); *F01D 25/12* (2013.01);
(Continued)

(58) Field of Classification Search
CPC . F01K 7/22; F01K 7/025; F01D 25/26; F01D 25/12; F01D 1/04; F05D 2220/31;
(Continued)

(56) References Cited

U.S. PATENT DOCUMENTS 3,773,431 A * 11/1973 Bellati ..... F01D 25/28 415/108
5,149,247 A 9/1992 Gros et al.
(Continued)

FOREIGN PATENT DOCUMENTS

DE 1872434 U 5/1963
DE 69000984 T2 6/1993
(Continued)

OTHER PUBLICATIONS

International search report and written opinion dated May 22, 2018, for corresponding PCT/EP2018/053634.

*Primary Examiner* — Hoang M Nguyen

(57) ABSTRACT

A steam turbine, having a steam turbine outer housing; a high-pressure inner housing having first process steam inlet and outlet sections for conducting process steam therethrough from the inlet to the outlet section in a first process steam expansion direction; a low-pressure inner housing having second process steam inlet and outlet sections for conducting process steam therethrough from the second process steam inlet section to the second process steam outlet section in a second process steam expansion direction; and an intermediate superheater, which is arranged downstream of the high-pressure inner housing and upstream of the low-pressure inner housing, wherein the high-pressure and low-pressure inner housings are arranged within the steam turbine outer housing and the high-pressure and the low-pressure inner housings are arranged in such a way that the first steam inlet section of the high-pressure inner
(Continued)

housing faces the second steam inlet section of the low-pressure inner housing.

9 Claims, 1 Drawing Sheet

(52) U.S. Cl.
CPC ..... *F05D 2220/31* (2013.01); *F05D 2240/14* (2013.01); *F05D 2260/2322* (2013.01); *F05D 2260/941* (2013.01)

(58) Field of Classification Search
CPC ..... F05D 2240/14; F05D 2260/2322; F05D 2260/941
USPC ..... 415/93–95, 101, 103; 60/653, 677–680
See application file for complete search history.

(56) References Cited

U.S. PATENT DOCUMENTS

| | | | | |
|---|---|---|---|---|
| 6,305,901 | B1 * | 10/2001 | Bell | F01D 1/16 415/100 |
| 6,345,952 | B1 * | 2/2002 | Oeynhausen | F01D 1/16 415/100 |
| 7,003,956 | B2 | 2/2006 | Yamashita et al. | |
| 7,404,699 | B2 | 7/2008 | Thamm et al. | |
| 10,227,873 | B2 | 3/2019 | Assmann et al. | |
| 2007/0071599 | A1 * | 3/2007 | Arai | C22C 38/44 415/200 |
| 2007/0166152 | A1 | 7/2007 | Thamm et al. | |
| 2008/0159849 | A1 * | 7/2008 | Heine | F01D 5/026 415/115 |
| 2010/0158666 | A1 | 6/2010 | Hernandez | |
| 2020/0056500 | A1 | 2/2020 | Uechi et al. | |

FOREIGN PATENT DOCUMENTS

| | | | |
|---|---|---|---|
| EP | 1559872 | A1 | 8/2005 |
| EP | 2565377 | A1 | 3/2013 |
| EP | 2997236 | B1 | 3/2017 |
| JP | S60195304 | A | 10/1985 |
| JP | S6164604 | U | 5/1986 |
| JP | H0749002 | A | 2/1995 |
| JP | 20100151130 | A | 7/2010 |
| JP | 2015010535 | A | 1/2015 |
| JP | 2018066364 | A | 4/2018 |
| RU | 2351766 | C2 | 4/2009 |
| RU | 2410545 | C2 | 1/2011 |
| WO | 2007006754 | A1 | 1/2007 |

* cited by examiner

STEAM TURBINE AND METHOD FOR OPERATING SAME

CROSS REFERENCE TO RELATED APPLICATIONS

This application is the US National Stage of International Application No. PCT/EP2018/053634 filed 14 Feb. 2018, and claims the benefit thereof. The International Application claims the benefit of German Application No. DE 10 2017 211 295.6 filed 3 Jul. 2017. All of the applications are incorporated by reference herein in their entirety.

FIELD OF INVENTION

The present invention relates to a steam turbine and to a method for operating the steam turbine.

BACKGROUND OF INVENTION

In steam power plants, steam is used as working medium for the operation of steam turbines. The water vapor is heated in a steam boiler and flows as process steam via pipelines into the steam turbine. In the steam turbine, the previously absorbed energy of the working medium is converted into kinetic energy. By means of the kinetic energy, a generator is operated, which converts the generated mechanical power into electrical power. The expanded and cooled process steam subsequently flows into a condenser, where it condenses as a result of heat transfer in a heat exchanger, and is fed as liquid water back to the steam boiler in order to be heated.

Conventional steam turbines have at least one high-pressure part and at least one low-pressure part. In the low-pressure part, the temperature of the process steam falls significantly, which can result in partial condensation of the process steam. Here, the low-pressure part is highly sensitive with regard to a moisture content of the process steam. If the process steam attains a moisture content of approximately 8 to 10 percent in the low-pressure part of the steam turbine, measures must be implemented which reduce the moisture content of the process steam to an admissible level before it enters the low-pressure part.

To increase the efficiency of a steam turbine, the process steam is, for this purpose, fed to an intermediate superheating process before entering the low-pressure part. In the intermediate superheating process, the process steam is heated such that the moisture content decreases. In the case of this intermediate superheating process, the entire steam mass flow is extracted from the steam turbine downstream of the high-pressure part, fed to the intermediate superheating process, and heated approximately to the temperature of the fresh steam. The process steam is subsequently fed to the low-pressure part. Without such an intermediate superheating process, it would be necessary for the steam turbine to be stopped, because condensing water droplets could strike the rotating turbine blades and would thus cause damage to the turbine.

In the case of multi-stage steam turbines, such intermediate superheating of the process steam is performed between the individual turbine stages. This leads to higher efficiency, because mechanical energy can be generated in the turbine stages more efficiently by means of the superheated water vapor.

In the case of the implementation of intermediate superheating systems in steam turbines, the material of the outer wall is subjected to high loading, in particular between the individual turbine stages. The relatively cold water vapor is extracted at the first turbine stage and is fed to the intermediate superheater, and the heated process steam is fed to the second turbine stage. Here, large temperature differences arise in the outer wall at the transition between the first turbine stage and the second turbine stage. Since the end of the first turbine stage, from which the relatively cold process steam is extracted, and the start of the second turbine stage, in which the hot process steam from the intermediate superheater is fed, are situated close together, high thermal stresses arise in the outer wall. This can lead to leaks or cracks in the outer wall. There is also the risk that wet steam parameters prevail during extraction of the cold process steam from the first turbine stage, and condensate thus forms on the inner wall of the outer housing. The condensate additionally cools the inner side of the outer wall. The thermal stress on the outer wall is thus increased. In order that the superheated process steam does not cause any damaging thermal stresses, the superheated process steam is cooled in order to reduce the thermal stresses. This is commonly performed in upstream inflow housings. These additional inflow housings can however lead to energy losses.

In the case of a single-shell or single-housing steam turbine with intermediate superheating, greatly superheated process steam is conducted into the turbine at two locations. Here, the steam turbine outer housing in particular is thermally highly loaded by the prevailing temperatures and pressures.

Steam turbines with intermediate superheating have hitherto either been designed as two-shell turbine housings, or lower steam parameters have been used, such that a single-shell steam turbine outer housing has not been overloaded.

The required parameters that arise however commonly lie above the possible parameters of single-shell turbine housings. The European patent EP 2 997 236 B 1 has disclosed a steam turbine which at least partially allows for the above problem.

SUMMARY OF INVENTION

The invention is based on an object of providing a compact, reliable and efficient steam turbine and a method for the corresponding operation of the steam turbine.

The above object is achieved by means of the patent claims. In particular, the above object is achieved by means of the steam turbine and the method as claimed. Further advantages of the invention will emerge from the subclaims, the description and the drawings. Here, features and details that are described in conjunction with the steam turbine self-evidently also apply in conjunction with the method according to the invention and vice versa in each case, such that reciprocal reference is always or can always be made in respect of the disclosure relating to the individual aspects of the invention.

According to a first aspect of the invention, a steam turbine is provided. The steam turbine has a steam turbine outer housing. Furthermore, the steam turbine has a high-pressure inner housing with a first process steam inlet portion and a first process steam outlet portion for conducting process steam through the high-pressure inner housing from the first process steam inlet portion to the first process steam outlet portion in a first process steam expansion direction. Furthermore, the steam turbine has a low-pressure inner housing with a second process steam inlet portion and a second process steam outlet portion for conducting process steam through the low-pressure inner housing from the second process steam inlet portion to the second process steam outlet portion in a second process steam expansion direction. Furthermore, the steam turbine has an intermediate superheater which is arranged downstream of the high-pressure inner housing and upstream of the low-pressure inner housing, wherein the high-pressure inner housing and the low-pressure inner housing are arranged within the steam turbine outer housing. The high-pressure inner housing and the low-pressure inner housing are arranged such that the first steam inlet portion of the high-pressure inner housing faces toward the second steam inlet portion of the low-pressure inner housing.

The statement that the first steam inlet portion of the high-pressure inner housing faces toward the second steam inlet portion of the low-pressure inner housing can be understood to mean that the first steam inlet portion of the high-pressure inner housing points or is oriented in the opposite direction, or substantially in the opposite direction, to the second steam inlet portion of the low-pressure inner housing. The first process steam expansion direction correspondingly runs oppositely or substantially oppositely to the second process steam expansion direction.

This means that the high-pressure inner housing and the low-pressure inner housing are arranged such that a process steam flow direction through the high-pressure inner housing runs oppositely, in particular oppositely by 180°, to a process steam flow direction through the low-pressure inner housing.

The arrangement according to the invention of the high-pressure inner housing and of the low-pressure inner housing constitutes a departure from the conventional design. In tests that were performed in the context of the present invention, it was found that, by means of the arrangement according to the invention, not only can the bearing spacing be shortened, but the steam turbine can also be operated in a particularly reliable manner. Owing to the shortened bearing spacing, the steam turbine can be of correspondingly compact construction. This results in turn in a particularly expedient design with regard to the rotor dynamics of the steam turbine.

Using the present steam turbine, superheated process steam in the form of fresh steam can be fed into the high-pressure inner housing, which has been rotated counter to a steam direction, and expanded to the pressure and temperature level of a so-called cold intermediate superheating process. After the process steam has emerged from the high-pressure inner housing, the process steam can be conducted to the intermediate superheater. Intermediate superheater process steam from the intermediate superheater can then be conducted into the low-pressure inner housing facing in a main flow direction, and can expand there in the steam turbine to the point of condensation.

The low-pressure inner housing is to be understood in the present case to mean an inner housing in which, at least on average, a lower pressure prevails or is generated than in the high-pressure inner housing. This means that the low-pressure inner housing can also be understood in particular to mean a medium-pressure inner housing. In a design variant, the low-pressure inner housing is therefore to be understood to mean a medium-pressure inner housing.

The process steam is to be understood to mean steam, in particular water vapor, which flows through components of the steam turbine during the operation of the steam turbine.

By means of the arrangement according to the invention of the high-pressure inner housing and of the low-pressure inner housing, exciting forces in the low-pressure inner housing can be minimized, because only the pressure difference from the intermediate superheating process acts. Process steam can, for the further expansion, be conducted directly into the next component, for example a further low-pressure inner housing, and does not first need to be diverted. In the case of the proposed arrangement, a sealing shell can furthermore be omitted. Specifically, at a second process steam outlet portion, the process steam can be conducted from the low-pressure inner housing or a medium-pressure inner housing directly into a low-pressure inner housing or a further low-pressure inner housing, because the process steam expansion direction of the low-pressure or medium-pressure inner housing has the same direction as the process steam expansion direction of the further low-pressure inner housing.

An expansion direction is to be understood in the present case to mean a direction in which the process steam is substantially moved or conducted. This means that, if the process steam in a steam turbine portion moves for example from the left to the right in spiral or helical fashion, this is to be understood, considered in simplified form, as a linear expansion direction to the right. Furthermore, in the present case, an expansion direction is to be understood to mean a pressure direction from a high-pressure region into a low-pressure region or into a pressure region with a lower pressure than in the high-pressure region. Correspondingly, an upstream steam turbine portion is to be understood to mean a portion which is arranged counter to the expansion direction.

In one refinement of the present invention, it is possible that, in a steam turbine, downstream of the high-pressure inner housing, there is formed a process steam diverting portion for diverting process steam from the first steam outlet portion in a direction counter to the first steam expansion direction into a cooling line of the steam turbine, wherein the cooling line is formed in a region adjacent to the high-pressure inner housing. In this way, cool process steam can be used in a simple and space-saving manner for cooling the steam turbine outer housing and thus for cooling the steam turbine. This has the result in turn that the steam turbine is protected against overheating and can thus be operated particularly reliably. For this purpose, the process steam from the high-pressure inner housing can be diverted into a main flow direction and conducted around the outside of the high-pressure inner housing. For the desired cooling effect, the cooling line is arranged or formed along an inner wall of the steam turbine outer housing and/or along an outer wall of the high-pressure inner housing.

It is furthermore possible that, in the case of a steam turbine according to the invention, the cooling line is arranged at least in certain portions between, in particular directly between, an inner wall of the steam turbine outer housing and an outer wall of the high-pressure inner housing. This means that the process steam can be conducted at least in certain portions around the high-pressure inner housing or along the high-pressure inner housing and can subsequently be discharged directly or indirectly through the steam turbine outer housing to the intermediate superheater. An advantageous cooling effect for the steam turbine outer housing can be achieved in this way.

It is furthermore possible that, in the case of a steam turbine according to the invention, the cooling line is additionally or alternatively arranged at least in certain portions between, in particular directly between, an inner wall of the steam turbine outer housing and an outer wall of the low-pressure inner housing. This means that the process steam can furthermore be conducted at least in certain portions around the low-pressure inner housing or along the low-pressure inner housing and can subsequently be discharged through the steam turbine outer housing to the intermediate superheater. In this way, the cooling effect for the steam turbine outer housing can be further intensified. Considered as a whole, a particularly space-saving, efficient and reliably functioning cooling system for the steam turbine is thus created.

Furthermore, in the case of a steam turbine according to the invention, it is furthermore possible that, at an upstream end portion of the high-pressure inner housing, at which the first process steam inlet portion is formed, there is arranged a high-pressure sealing shell for sealing the upstream end portion of the high-pressure inner housing and, at an upstream end portion of the low-pressure inner housing, at which the second process steam inlet portion is formed, there is arranged a low-pressure sealing shell for sealing the upstream end portion of the low-pressure inner housing, wherein the high-pressure sealing shell and the low-pressure sealing shell are arranged adjacent to one another. In tests that were performed in the context of the present invention, it was found that a steam turbine with the two sealing shells in this region is easy to assemble, disassemble, maintain and repair. A relatively compact design can nevertheless be achieved. An adjacent arrangement is to be understood in the present case to mean an arrangement next to one another, that is to say not imperatively directly next to one another. That is to say, yet further components may be arranged between the sealing shells, or the two sealing shells are advantageously arranged next to one another with a small spacing but not directly against one another.

It is alternatively possible that, in the case of a steam turbine according to the invention, at an upstream end portion of the high-pressure inner housing, at which the first process steam inlet portion is formed, and at an upstream end portion of the low-pressure inner housing, at which the second process steam inlet portion is formed, there is arranged a common sealing shell for sealing the two end portions. By means of this design or measure, the steam turbine can be provided in a particularly compact form. Furthermore, the use of a further sealing shell can be omitted. This leads to a weight saving in the case of the steam turbine and to a reduction in the logistical effort in the production of the steam turbine.

Furthermore, in the case of a steam turbine according to the invention, at a downstream end portion of the low-pressure inner housing, there may be formed a sealing web for sealing a steam turbine region between the downstream end portion of the low-pressure inner housing and the steam turbine outer housing. In the case of the present steam turbine, the low-pressure inner housing is flowed around by process steam during operation, while the high-pressure inner housing is separated from the low-pressure inner housing by the sealing web, which is advantageously formed as an integrated sealing web on the downstream end portion of the low-pressure inner housing. Using the sealing web, an inner sealing shell at the downstream end portion of the low-pressure inner housing can be omitted. The sealing web has a much less complex construction than a sealing shell. It is pointed out at this juncture that, in the present case, a sealing shell is to be understood to mean a sealing shell which is common in the prior art and which will therefore not be described in detail here.

It may furthermore be advantageous if the intermediate superheater is arranged outside the steam turbine outer housing. This is advantageous in particular with regard to the assembly, disassembly, maintenance and repair of the steam turbine.

In the case of a steam turbine according to the invention, it is furthermore possible that the high-pressure inner housing and the low-pressure inner housing are provided as separate components. This has the advantage that the steam turbine can be constructed easily and inexpensively in accordance with the modular principle. The present invention relates here advantageously to the expansion of process steam in a single steam turbine outer housing from a high pressure to a pressure below an intermediate superheating pressure. A low-pressure expansion may be performed in a separate portion of the same steam turbine or in a separate low-pressure steam turbine.

According to a further aspect of the present invention, a method for operating a steam turbine as presented in detail above is provided. A method according to the invention thus yields the same advantages as have been described in detail with reference to the steam turbine according to the invention. The method has the following steps: —conducting process steam from a process steam source through the first process steam inlet portion into the high-pressure inner housing, —conducting the process steam from the first process steam inlet portion to the first process steam outlet portion, and —conducting the process steam through the first process steam outlet portion from the high-pressure inner housing via the process steam diverting portion and the cooling line to the intermediate superheater.

By means of the method presented above, the steam turbine can be cooled in a simple and compact manner. By means of reliable cooling of the steam turbine, this can also be operated in a reliable manner. Classically, a method for the reliable cooling of a steam turbine is provided.

Further measures which improve the invention will emerge from the following description of various exemplary embodiments of the invention, which are illustrated schematically in the figures. All of the features and/or advantages that emerge from the claims, the description or the drawing, including design details and spatial arrangements, may be essential to the invention both on their own and in the various combinations.

DETAILED DESCRIPTION OF INVENTION

Figure 1:
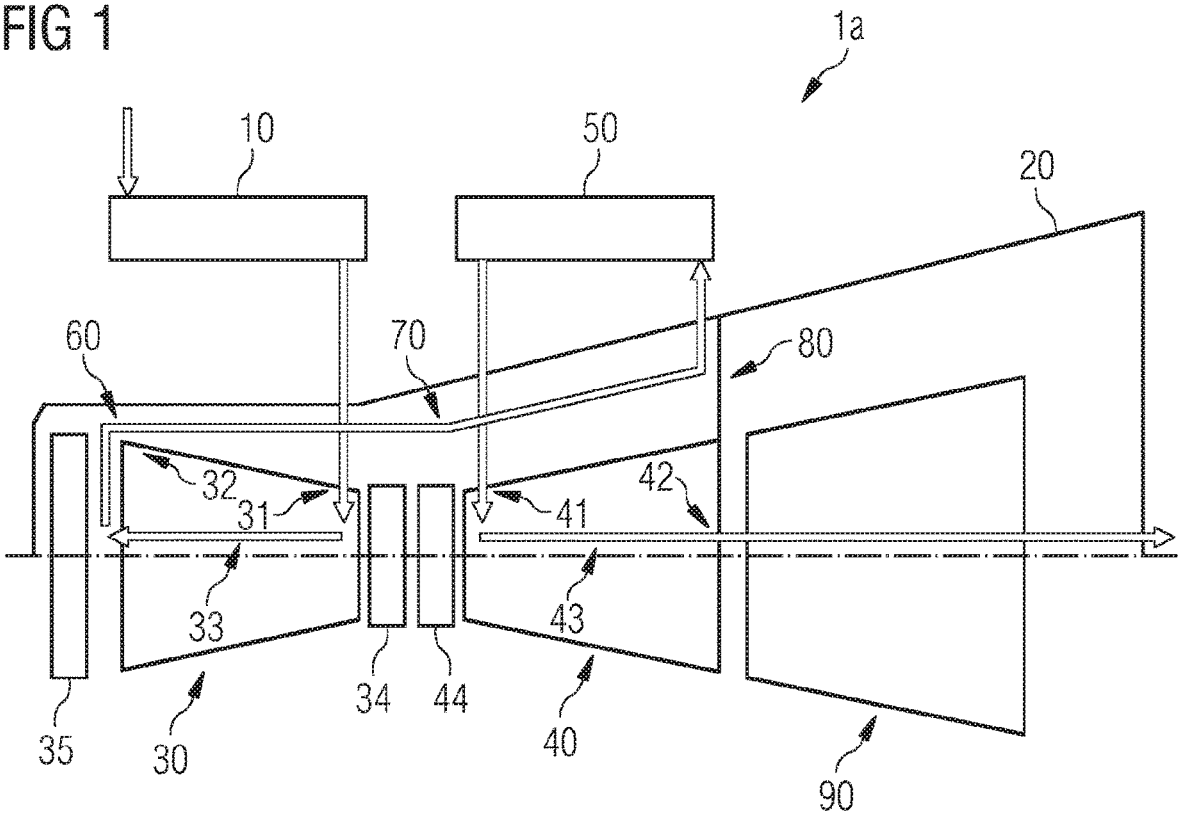
FIG. 1 shows a block diagram for illustrating a steam turbine according to a first embodiment of the present invention.
Figure 2:
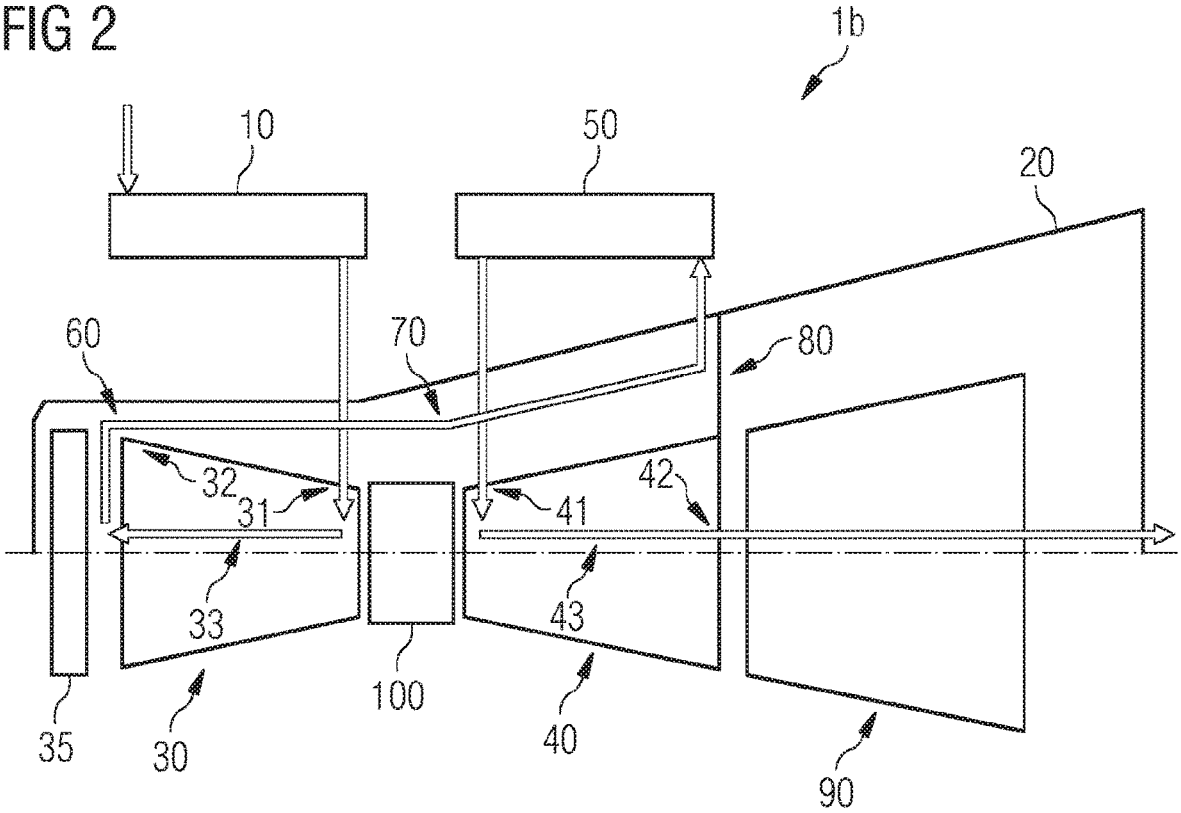
FIG. 2 shows a block diagram for illustrating a steam turbine according to a second embodiment of the present invention.

Elements of identical function and mode of action are denoted in each case by the same reference designations in FIGS. 1 and 2.

FIG. 1 illustrates a steam turbine 1*a* according to a first embodiment. The steam turbine 1*a* has a steam turbine outer housing 20, in which there are situated a high-pressure inner housing 30, a low-pressure inner housing 40 in the form of a medium-pressure inner housing, and a further low-pressure inner housing 90. Arranged upstream of the high-pressure inner housing 30 is a fresh steam or process steam source 10 for the supply of process steam to the high-pressure inner housing 30. The high-pressure inner housing 30 has a first process steam inlet portion 31 and a first process steam outlet portion 32 for conducting process steam through the high-pressure inner housing 30 from the first process steam inlet portion 31 to the first process steam outlet portion 32 in a first process steam expansion direction 33. The low-pressure inner housing 40 has a second process steam inlet portion 41 and a second process steam outlet portion 42 for conducting process steam through the low-pressure inner housing 40 from the second process steam inlet portion 41 to the second process steam outlet portion 42 in a second process steam expansion direction 43. The steam turbine 1*a* furthermore has an intermediate superheater 50, which is arranged downstream of the high-pressure inner housing 30 and upstream of the low-pressure inner housing 40.

As illustrated in FIG. 1, the high-pressure inner housing 30 and the low-pressure inner housing 40 are arranged such that the first process steam inlet portion 31 of the high-pressure inner housing 30 faces toward the second process steam inlet portion 41 of the low-pressure inner housing 40.

Downstream of the high-pressure inner housing 30, the steam turbine 1*a* has a process steam diverting portion 60 for diverting process steam from the first process steam outlet portion 32 in a direction counter to the first process steam expansion direction 33 into a cooling line 70 of the steam turbine 1*a*. The cooling line 70 is formed within the steam turbine outer housing 20 in a region adjacent to the high-pressure inner housing 30. The cooling line 70 is furthermore arranged in certain portions between an inner wall of the steam turbine outer housing 20 and an outer wall of the high-pressure inner housing 30. Furthermore, the cooling line 70 is arranged in certain portions between an inner wall of the steam turbine outer housing 20 and an outer wall of the low-pressure inner housing 40.

In the first embodiment, at an upstream end portion of the high-pressure inner housing 30, at which the first process steam inlet portion 31 is formed, there is arranged a high-pressure sealing shell 34 for at least partially sealing the upstream end portion of the high-pressure inner housing 30. Furthermore, at an upstream end portion of the low-pressure inner housing 40, at which the second process steam inlet portion 41 is formed, there is arranged a low-pressure sealing shell 44 for at least partially sealing the upstream end portion of the low-pressure inner housing 40. The high-pressure sealing shell 34 and the low-pressure sealing shell 44 are arranged adjacent to one another. At a downstream end portion of the high-pressure inner housing 30, at which the first process steam outlet portion 32 is formed, there is arranged a further high-pressure sealing shell 35 for at least partially sealing the downstream end portion of the high-pressure inner housing 30.

At a downstream end portion of the low-pressure inner housing 40, there is formed a sealing web 80 for sealing a steam turbine region between the downstream end portion of the low-pressure inner housing 40 and the steam turbine outer housing 20. The intermediate superheater is arranged outside the steam turbine outer housing 20. The high-pressure inner housing 30 and the low-pressure inner housing 40 are provided as separate components in a common steam turbine outer housing 20.

A steam turbine 1*b* according to a second embodiment will be described with reference to FIG. 2. The steam turbine 1*b* according to the second embodiment corresponds substantially to the steam turbine 1*a* according to the first embodiment. Instead of the two separate sealing shells or the high-pressure sealing shell 34 and the low-pressure sealing shell 44, only a single sealing shell 100 is arranged between the high-pressure inner housing 30 and the low-pressure inner housing 40.

A method according to an embodiment will be described below with reference to FIG. 1. In the context of the method, it is firstly the case that process steam from the process steam source 10 is conducted through the first process steam inlet portion 31 into the high-pressure inner housing 30. Subsequently, the process steam is conducted from the first process steam inlet portion 31 to the first process steam outlet portion 32 and subsequently through the first process steam outlet portion 32 from the high-pressure inner housing 30 via the process steam diverting portion 60 and the cooling line 70 to the intermediate superheater 50. Here, the process steam is conducted through the cooling line 70, for the purposes of cooling the steam turbine outer housing 20 or the steam turbine 1*a*, along the high-pressure inner housing 30 and along the low-pressure inner housing 40. After the process steam has been heated to a predefined temperature at constant pressure in the intermediate superheater 50, the heated or superheated process steam is conducted from the intermediate superheater 50 through the second process steam inlet portion 41 into the low-pressure or medium-pressure inner housing. From there, the process steam is conducted, maintaining the same expansion direction, into the further low-pressure inner housing. There, the process steam can expand further and condense.

LIST OF REFERENCE DESIGNATIONS

1 Steam turbine
10 Process steam source
20 Turbine outer housing
30 High-pressure inner housing
31 First process steam inlet portion
32 First process steam outlet portion
33 First process steam expansion direction
34 High-pressure sealing shell
35 High-pressure sealing shell
40 Low-pressure inner housing
41 Second process steam inlet portion
42 Second process steam outlet portion
43 Second process steam expansion direction
44 Low-pressure sealing shell
50 Intermediate superheater
60 Process steam diverting portion
70 Cooling line
80 Sealing web
90 Low-pressure inner housing
100 Sealing shell

The invention claimed is:

1. A steam turbine, comprising:

a steam turbine outer housing, a high-pressure inner housing with a first process steam inlet portion and a first process steam outlet portion for conducting process steam through the high-pressure inner housing from the first process steam inlet portion to the first process steam outlet portion in a first process steam expansion direction, a low-pressure inner housing with a second process steam inlet portion and a second process steam outlet portion for conducting process steam through the low-pressure inner housing from the second process steam inlet portion to the second process steam outlet portion in a second process steam expansion direction, and an intermediate superheater which is arranged downstream of the high-pressure inner housing and upstream of the low-pressure inner housing, wherein the high-pressure inner housing and the low-pressure inner housing are arranged within the steam turbine outer housing, wherein the high-pressure inner housing and the low-pressure inner housing are arranged such that the first process steam inlet portion of the high-pressure inner housing faces toward the second process steam inlet portion of the low-pressure inner housing wherein, downstream of the high-pressure inner housing, there is formed a process steam diverting portion for diverting process steam from the first process steam outlet portion in a direction counter to the first process steam expansion direction into a cooling line of the steam turbine, wherein the cooling line is formed in a region adjacent to the high-pressure inner housing.

2. The steam turbine as claimed in claim 1, wherein the cooling line is arranged at least in certain portions between, or directly between, an inner wall of the steam turbine outer housing and an outer wall of the high-pressure inner housing.

3. The steam turbine as claimed in claim 1, wherein the cooling line is arranged at least in certain portions between, or directly between, an inner wall of the steam turbine outer housing and an outer wall of the low-pressure inner housing.

4. The steam turbine as claimed in claim 1, wherein, at an upstream end portion of the high-pressure inner housing, at which the first process steam inlet portion is formed, there is arranged a high-pressure sealing shell for at least partially sealing the upstream end portion of the high-pressure inner housing and, wherein at an upstream end portion of the low-pressure inner housing, at which the second process steam inlet portion is formed, there is arranged a low-pressure sealing shell for at least partially sealing the upstream end portion of the low-pressure inner housing, wherein the high-pressure sealing shell and the low-pressure sealing shell are arranged adjacent to one another.

5. The steam turbine as claimed in claim 1, wherein, at an upstream end portion of the high-pressure inner housing, at which the first process steam inlet portion is formed, and at an upstream end portion of the low-pressure inner housing, at which the second process steam inlet portion is formed, there is arranged a common sealing shell for at least partially sealing the two end portions.

6. The steam turbine as claimed in claim 1, wherein, at a downstream end portion of the low-pressure inner housing, there is formed a sealing web for sealing a steam turbine region between the downstream end portion of the low-pressure inner housing and the steam turbine outer housing.

7. The steam turbine as claimed in claim 1, wherein the intermediate superheater is arranged outside the steam turbine outer housing.

8. The steam turbine as claimed in claim 1, wherein the high-pressure inner housing and the low-pressure inner housing are provided as separate components in a single steam turbine outer housing.

9. A method for operating a steam turbine as claimed in claim 1, the method comprising:

conducting process steam from a process steam source through the first process steam inlet portion into the high-pressure inner housing, conducting the process steam from the first process steam inlet portion to the first process steam outlet portion, and conducting the process steam through the first process steam outlet portion from the high-pressure inner housing via the process steam diverting portion and a cooling line to the intermediate superheater.

* * * * *